US009242468B2

(12) United States Patent
Kuroda et al.

(10) Patent No.: US 9,242,468 B2
(45) Date of Patent: Jan. 26, 2016

(54) LIQUID EJECTION APPARATUS

(71) Applicant: DAINIPPON SCREEN MFG. CO., LTD., Kyoto-shi, Kyoto (JP)

(72) Inventors: Takashi Kuroda, Kyoto (JP); Tamio Fukui, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/207,108

(22) Filed: Mar. 12, 2014

(65) Prior Publication Data

US 2014/0267490 A1 Sep. 18, 2014

(30) Foreign Application Priority Data

Mar. 13, 2013 (JP) ..... P2013-049886

(51) Int. Cl.
*B41J 2/165* (2006.01)

(52) U.S. Cl.
CPC ..... *B41J 2/16505* (2013.01); *B41J 2/16585* (2013.01)

(58) Field of Classification Search
CPC ..... B41J 2/16505
See application file for complete search history.

(56) References Cited

U.S. PATENT DOCUMENTS

2002/0041303 A1* 4/2002 Yoshinaga ..... 347/22
2002/0109768 A1* 8/2002 Greive ..... 347/104
2009/0058925 A1* 3/2009 Hayashi et al. ..... 347/30

FOREIGN PATENT DOCUMENTS

JP 2007-136989 A 6/2007

* cited by examiner

*Primary Examiner* — Manish S Shah
*Assistant Examiner* — Jeffrey C Morgan
(74) *Attorney, Agent, or Firm* — McDermott Will & Emery LLP

(57) ABSTRACT

In an inkjet printer, a cap part for receiving ink from a head unit during maintenance includes a liquid receiving part and an exhaust part disposed laterally to the liquid receiving part. In the liquid receiving part, a second liquid receiving chamber is disposed further from the exhaust part than is a first liquid receiving part. A second flow path is disposed below the first liquid receiving chamber without passing through the first liquid receiving chamber. In the exhaust part, a first fan part is connected to the first liquid receiving chamber, and a second fan part is connected to the second liquid receiving chamber through the second flow path. Accordingly, it is possible to appropriately exhaust a gas contained within the second liquid receiving chamber, independently of the first liquid receiving chamber. Consequently, a mist in the liquid receiving part can be discharged efficiently.

15 Claims, 9 Drawing Sheets

XIII – XIII

LIQUID EJECTION APPARATUS

TECHNICAL FIELD

The present invention relates to a liquid ejection apparatus.

BACKGROUND ART

Conventionally, inkjet printers have been used to print an image onto printing paper by ejecting fine droplets of ink from a plurality of outlets of a head unit toward the printing paper while moving the printing paper relative to the head unit.

As one method for inkjet printers to resolve clogging or the like of the outlets of a head unit, purging is known in which pressure is applied to a flow path of ink in the head unit so as to push the ink out of the outlets. In order to prevent an increase in the viscosity of ink due to evaporation of moisture in the ink, for example, spitting in which ink droplets are ejected periodically is also carried out during standby before printing. Purging and spitting are generally conducted while the head unit vertically opposes a cap part disposed under the head part, and the ink ejected from the head unit is received by the cap part.

In an image recording apparatus disclosed in Japanese Patent Application Laid-Open No. 2007-136989, an evacuation pump is actuated during maintenance of a recording head while the nozzle surface of the recording head is capped with an evacuation cap, so that ink is evacuated out of nozzles.

Incidentally, in the case where the aforementioned purging or spitting is performed, a spatter of ink that has collided with the bottom surface of the liquid receiving part of the cap part may be transformed into a mist, or a mist may be generated from flying ink droplets. Such an ink mist, if left as it is, may adhere to an ejection surface of the head unit in which the outlets are provided, or may be diffused into the inkjet printer. In view of this, an evacuation mechanism such as a fan is provided laterally to the liquid receiving part so that the ink mist is evacuated through the space between the ejection surface of the head unit and the bottom surface of the liquid receiving part and discharged to the outside.

However, in the case of a large inkjet printer in which the head unit and the liquid receiving part are also large, if an ink mist is sucked using a fan attached to one side surface of the liquid receiving part, the ink mist may be hardly sucked at positions distanced from the fan, although the ink mist can be sucked in the vicinity of the fan. In order to efficiently suck an ink mist in the entire liquid receiving part, it is conceivable to provide fans on other side surfaces of the liquid receiving part, but disposing fans on multiple side surfaces of the liquid receiving part is difficult because the head unit has a large number of pipes and wires connected thereto. Even if fans could be disposed on multiple side surfaces of the liquid receiving part, this in turn increases the size of the inkjet printer.

SUMMARY OF INVENTION

The present invention is intended for a liquid ejection apparatus, and it is an object of the present invention to efficiently discharge a mist in a liquid receiving part.

The liquid ejection apparatus according to the present invention includes an ejecting part for ejecting a liquid toward a base material, the ejecting part and the base material moving relative to each other in a predetermined movement direction, and a cap part for receiving the liquid ejected from the ejecting part during maintenance. The cap part includes a liquid receiving part for receiving the liquid ejected from the ejecting part while facing the ejecting part during maintenance, and an exhaust part disposed laterally to the liquid receiving part and for evacuating a gas contained within the liquid receiving part. The liquid receiving part includes a first liquid receiving chamber having an opening opposing a portion of the ejecting part, a second liquid receiving chamber disposed further from the exhaust part than is the first liquid receiving chamber, separated from the first liquid receiving chamber by a division wall, and having an opening opposing another portion of the ejecting part, and a flow path disposed without passing through the first liquid receiving chamber, and connecting the second liquid receiving chamber and the exhaust part. The exhaust part includes a first fan part connected to the first liquid receiving chamber and for evacuating a gas contained within the first liquid receiving chamber, and a second fan part connected to the second liquid receiving chamber through the flow path and for evacuating a gas contained within the second liquid receiving chamber. With this liquid ejection apparatus, it is possible to efficiently discharge a mist in the liquid receiving part.

In a preferred embodiment of the present invention, the ejecting part includes a plurality of head parts arranged in the movement direction, the first liquid receiving chamber includes a plurality of first small chambers that respectively oppose the plurality of head parts during maintenance and that are separated from one another by division walls, the second liquid receiving chamber includes a plurality of second small chambers that respectively oppose the plurality of head parts during maintenance and that are separated from one another by division walls, the first fan part includes a plurality of first fans that are respectively connected to the plurality of first small chambers, and the second fan part includes a plurality of second fans that are respectively connected to the plurality of second small chambers.

Another liquid ejection apparatus according to the present invention includes an ejecting part for ejecting a liquid toward a base material, the ejecting part and the base material moving relative to each other in a predetermined movement direction, and a cap part for receiving the liquid ejected from the ejecting part during maintenance. The cap part includes a liquid receiving part for receiving the liquid ejected from the ejecting part while facing the ejecting part during maintenance, and an exhaust part disposed laterally to the liquid receiving part and for evacuating a gas contained within the liquid receiving part. The liquid receiving part includes a first liquid receiving chamber having an opening opposing a portion of the ejecting part, a second liquid receiving chamber disposed further from the exhaust part than is the first liquid receiving chamber, separated from the first liquid receiving chamber by a division wall, and having an opening opposing another portion of the ejecting part, and a flow path disposed without passing through the first liquid receiving chamber, and connecting the second liquid receiving chamber and the exhaust part. By the exhaust part evacuating a gas, a mist contained in the first liquid receiving chamber and a mist contained in the second liquid receiving chamber are discharged together with the gas. With this liquid ejection apparatus, it is possible to efficiently discharge a mist in the liquid receiving part.

In another preferred embodiment of the present invention, the liquid ejection apparatus includes a box-shaped first container, and a box-shaped second container in which the first container is located. The first container serves as the first liquid receiving chamber, the second liquid receiving chamber is located between the second container and the first container, on an opposite side of the first container from the exhaust part, and a gap between a bottom surface of the first container and a bottom surface of the second container is included in the flow path.

In another preferred embodiment of the present invention, the ejecting part includes a plurality of head parts arranged in the movement direction, and the first liquid receiving chamber and the second liquid receiving chamber are each long in the movement direction and provided across the plurality of head parts, and each receive a liquid ejected from the plurality of head parts during maintenance.

In another preferred embodiment of the present invention, a surface in which the opening of the first liquid receiving chamber is provided is a closed surface, except for the opening, and a surface in which the opening of the second liquid receiving chamber is provided is a closed surface, except for the opening.

In another preferred embodiment of the present invention, a bottom surface of the first liquid receiving chamber and a bottom surface of the second liquid receiving chamber are each an inclined surface that is inclined downward away from the exhaust part.

In another preferred embodiment of the present invention, the ejecting part ejects fine droplets of ink.

These and other objects, features, aspects and advantages of the present invention will become more apparent from the following detailed description of the present invention when taken in conjunction with the accompanying drawings.

DESCRIPTION OF EMBODIMENTS

Figure 1:
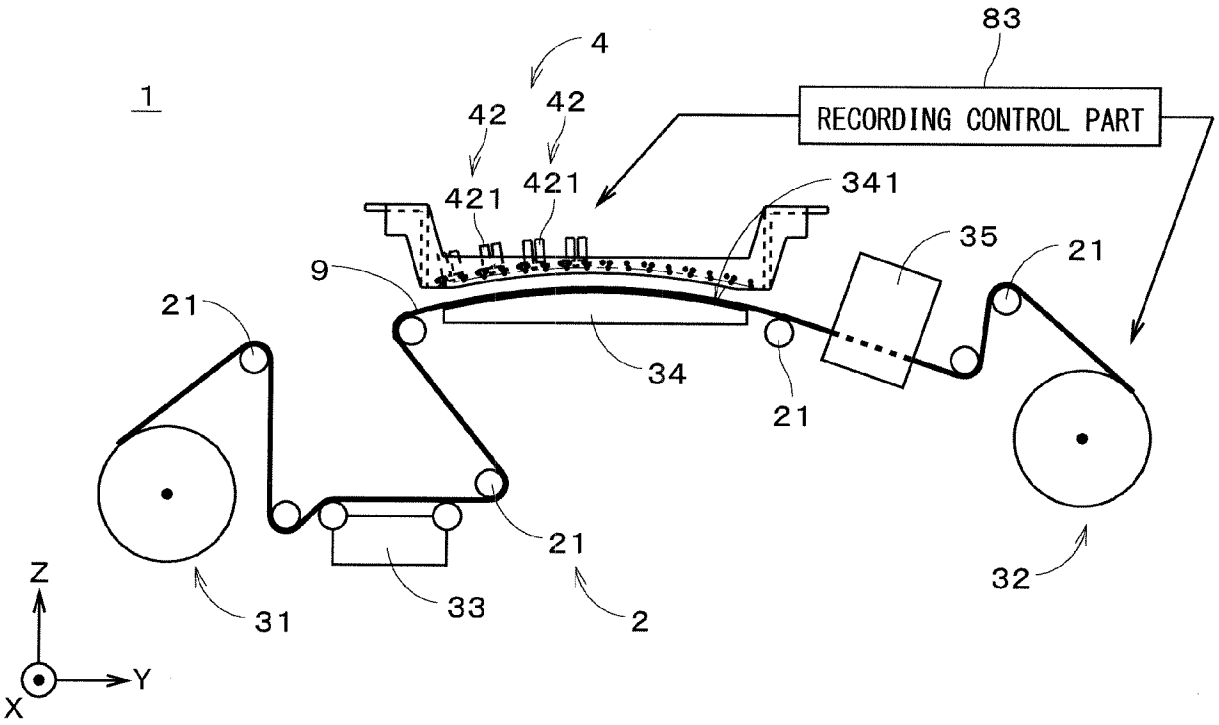
FIG. 1 illustrates a configuration of an inkjet printer according to a first embodiment.

FIG. 1 illustrates a configuration of an inkjet printer 1 that is a liquid ejection apparatus according to an embodiment of the present invention. The inkjet printer 1 is an apparatus for forming an image on a base material 9 in continuous sheet form, such as continuous form paper, by ejecting fine droplets of ink toward the base material 9. In FIG. 1, it is assumed that the two horizontal directions perpendicular to each other are X and Y directions and the vertical direction perpendicular to the X and Y directions is a Z direction. The X and Y directions in FIG. 1 do not necessarily have to be in the horizontal direction, and the Z direction also does not necessarily have to be in the vertical direction. In other words, the upper and lower sides in FIG. 1 do not necessarily have to correspond to the upper and lower sides in the direction of gravity. In FIG. 1, a maintenance part, which will be described later, is not shown.

The inkjet printer 1 includes a conveying mechanism 2, a head unit 4, and a recording control part 83. The conveying mechanism 2 is configured to move the base material 9, which is in sheet form. The head unit 4 is an ejecting part for ejecting fine droplets of UV curing ink toward the base material 9 that is being moved by the conveying mechanism 2. The recording control part 83 is configured to control the conveying mechanism 2 and the head unit 4 when an image is recorded onto the base material 9.

The conveying mechanism 2 shown in FIG. 1 includes a plurality of rollers 21 that are each long in the X direction in FIG. 1. In the vicinity of the roller 21 that is disposed furthest to the −Y side is provided a supply part 31 for holding a roll of base material 9 (supply roll). In the vicinity of the roller 21 that is disposed furthest to the +Y side is provided a take-up part 32 for holding the roll of base material 9 (take-up roll). In the inkjet printer 1, some of the rollers 21 of the conveying mechanism 2 rotate at a constant rotational speed about an axis parallel to the X direction, so that the base material 9 moves at a constant speed along a predetermined travel path from the supply part 31 to the take-up part 32.

On the travel path of the base material 9, a base material guiding part 34 is provided at a position vertically opposing the head unit 4. The base material guiding part 34 has a curved upper surface 341 (hereinafter, referred to as a "guideway 341"). The guideway 341 is part of a cylindrical surface that centers on a virtual axis parallel to the X direction. This virtual axis is located immediately under the head unit 4 (on the −Z side). Under the head unit 4, the base material 9 moves along the smooth guideway 341. In this way, the travel path of the base material 9 curves upward toward the head unit 4 at the position opposing the head unit 4, and accordingly the base material 9 is stretched along the guideway 341. At the position opposing the head unit 4, the base material 9 moves relative to the head unit 4 along the guideway 341 in a predetermined movement direction that is roughly in the +Y direction.

On the travel path of the base material 9, a skew correction part 33 for correcting skewing of the base material 9 is provided between the supply part 31 and the base material guiding part 34, and a curing part 35 for emitting light (in the present embodiment, ultraviolet rays) for curing ink is provided between the base material guiding part 34 and the take-up part 32. Note that the inkjet printer 1 may be provided with other constituent elements such as a pre-processing part for performing predetermined pre-processing on the base material 9.

Figure 2:
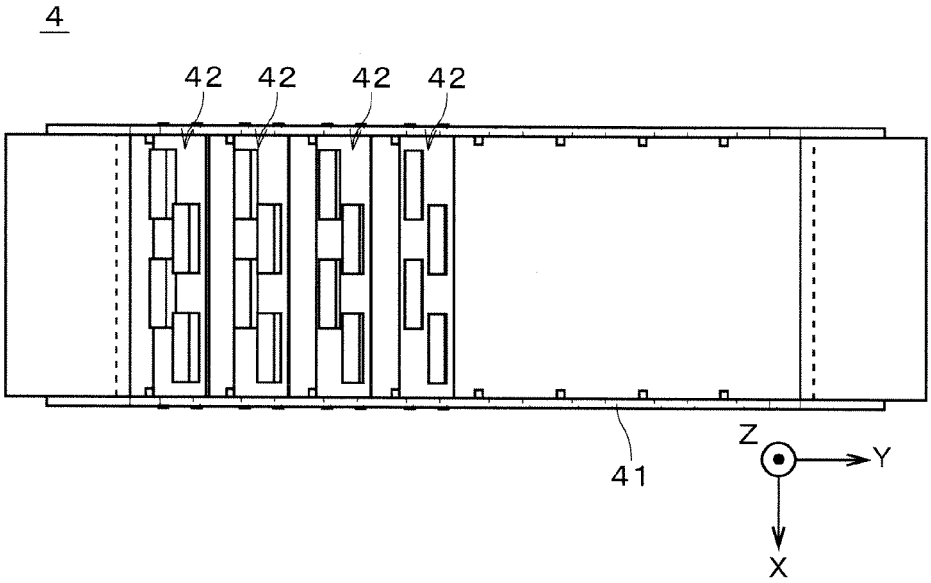
FIG. 2 is a plan view of a head unit.
Figure 3:
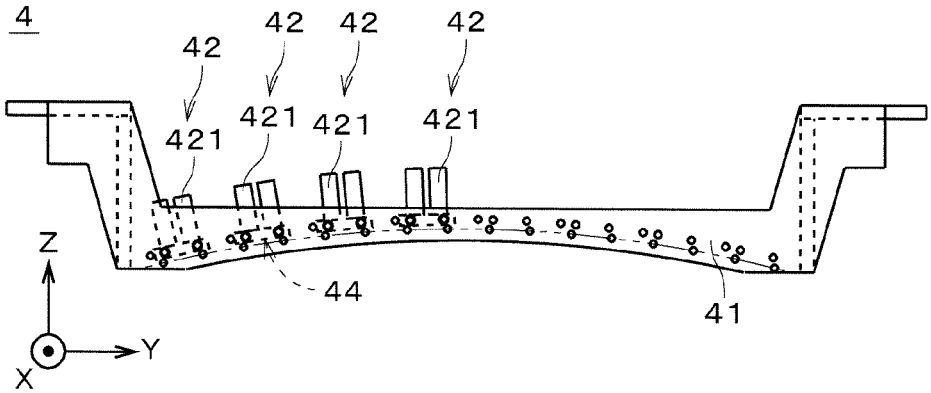
FIG. 3 is a front view of the head unit.

FIG. 2 is a plan view of the head unit 4, and FIG. 3 is a front view of the head unit 4. The head unit 4 includes head assemblies 42 that are a plurality of head parts each being long in the X direction, and a base 41 for supporting the plurality of head assemblies 42. The head assemblies 42 are arranged in substantially the Y direction (to be precise, in the aforementioned movement direction). Each of the head assemblies 42 ejects fine droplets of ink toward the base material 9.

In the present embodiment, four head assemblies 42 are mounted on the base 41. In the head unit 4, the head assemblies 42 for respectively ejecting inks of black (K), cyan (C), magenta (M), and yellow (Y) are arranged from the −Y side in the stated order. Mounted on the base 41 may be other head assemblies 42 for ejecting inks of white or specific colors, for example. Alternatively, the head assemblies 42 may eject other types of ink such as invisible ink.

The base 41 may also have mounted thereon an emitting assembly for emitting light toward the base material 9, in addition to the head assemblies 42. In this case, the inks ejected on the base material 9 will be pre-cured by irradiation with the light (ultraviolet rays) emitted from the emitting assembly onto the base material 9. A maximum of eight assemblies including the head assemblies 42 and the emitting assembly are mountable on the base 41. The number, type, and mounting positions of assemblies mounted on the base 41 may be appropriately changed. Also, the maximum number of mountable assemblies on the base 41 is not limited to eight.

Figure 4:
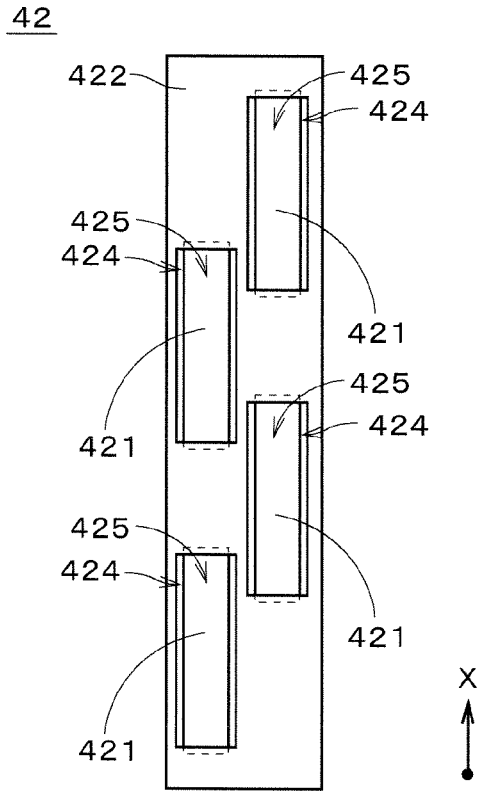
FIG. 4 is a bottom view of a head assembly.
Figure 5:
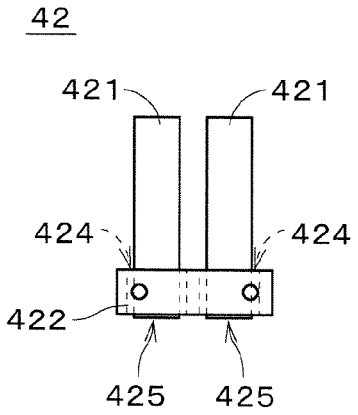
FIG. 5 is a front view of the head assembly.

FIG. 4 is a bottom view of one head assembly 42, and FIG. 5 is a front view of the head assembly 42. The following description focuses on the head assembly 42 for ejecting an ink of one color, but the other head assemblies 42 also have the same configuration. The head assembly 42 is fixed to the base 41 in an orientation in which the head assembly 42 is inclined by a slight rotation angle with respect to an axis parallel to the longitudinal direction of the head assembly 42 (X direction). Thus, strictly speaking, the lateral direction in FIG. 4 does not correspond to that in FIG. 2, and the longitudinal and lateral directions in FIG. 5 also do not correspond to those in FIG. 3. The lateral directions in FIGS. 4 and 5 substantially correspond to the movement direction of the base material 9 that moves under the head assemblies 42.

The head assembly 42 includes a head fixation block 422 having a substantially rectangular parallelepiped shape that is long in the X direction, and a plurality of ejection heads 421 that are each long in the X direction. In the present embodiment, four ejection heads 421 are mounted on the head fixation block 422. The head fixation block 422 is a head holding part for holding a plurality of ejection heads 421. By mounting the ejection heads 421 on the head fixation block 422, the relative positions of the ejection heads 421 are fixed, and the positions of the ejection heads 421 relative to the head fixation block 422 are also fixed.

The head fixation block 422 is formed of, for example, metal such as stainless steel. The head fixation block 422 has a plurality of through holes 424 arranged in a staggered configuration in the longitudinal direction. The ejection heads 421 are fixed to the head fixation block 422 in such a way that their lower ends (i.e., their ends on the −Z side) are respectively inserted in the through holes 424. Accordingly, the ejection heads 421 are arranged in a staggered configuration on the head fixation block 422. The opposite ends of each of the ejection heads 421 in the longitudinal direction (X direction) are secured by screws or the like to the upper surface of the head fixation block 422.

Each of the ejection heads 421 has, in its lower end surface, namely, a head lower surface 425, a plurality of outlets arranged along its length, i.e., in the X direction. The head assembly 42 has a larger number of outlets arranged at a substantially constant pitch along its length, i.e., in the X direction, over the entire range from the vicinity of one end of the head fixation block 422 to the vicinity of the other end. In the following description, the X direction is referred to as an "arrangement direction." The arrangement direction is substantially perpendicular to the aforementioned movement direction. Note that the arrangement direction does not necessarily have to be perpendicular to the movement direction as long as it intersects the movement direction.

In the head unit 4 shown in FIG. 3, the head lower surfaces 425 (see FIG. 5) of a plurality of (in the present embodiment, 16) ejection heads 421 are disposed at an ejection surface 44 that is the lower surface of the head unit 4. The head lower surfaces 425 are outlet existence regions in which a plurality of outlets for ejecting ink are disposed. The outlet existence regions are included in the ejection surface 44 of the head unit 4.

In the head unit 4 shown in FIG. 1, the head lower surfaces 425 of the ejection heads 421 in each of the head assemblies 42 are substantially parallel to the main surface of the base material 9 on the guideway 341. In other words, the ejection heads 421 are in upright positions relative to the base material 9. Fine droplets of ink are ejected from the outlets of the respective ejection heads 421 toward the main surface of the base material 9 in a direction substantially perpendicular to that main surface. In the case of recording an image onto the base material 9, a head elevating mechanism (not shown) lowers the head unit 4 toward the guideway 341 so as to bring the head lower surfaces 425 of the respective ejection heads 421 close to the main surface of the base material 9.

In the image forming processing of the inkjet printer 1, continuous portions of the base material 9 are sequentially drawn out from the supply part 31, and each of the portions (hereinafter, referred to as a "target portion") passes through the skew correction part 33 and reaches the base material guiding part 34. In the base material guiding part 34, the target portion moves in the movement direction while remaining in contact with the guideway 341, and the head unit 4 opposing the base material guiding part 34 records an image onto the target portion. Specifically, the four head assemblies 42 for respectively ejecting inks of K, C, M, and Y record color images of K, C, M, and Y onto the target portion. Thereafter, the target portion moves to the curing part 35, in which the inks are cured, and is then taken up by the take-up part 32. This completes the image formation on the target portion.

In each of the head assemblies 42, the outlets are arranged in the X direction perpendicular to the movement direction across the entire width of an image recording region of the base material 9. In the inkjet printer 1, the recording of an image onto the base material 9 is completed in one pass of the base material 9 under the head unit 4 by the recording control part 83 (see FIG. 2) controlling the conveying mechanism 2 and the head unit 4. In other words, an image is recorded onto the base material 9 by the base material 9 moving only once in the movement direction relative to the head unit 4. In this way, the inkjet printer 1 that implements so-called single pass printing allows an image to be formed in a short time.

Figure 6:
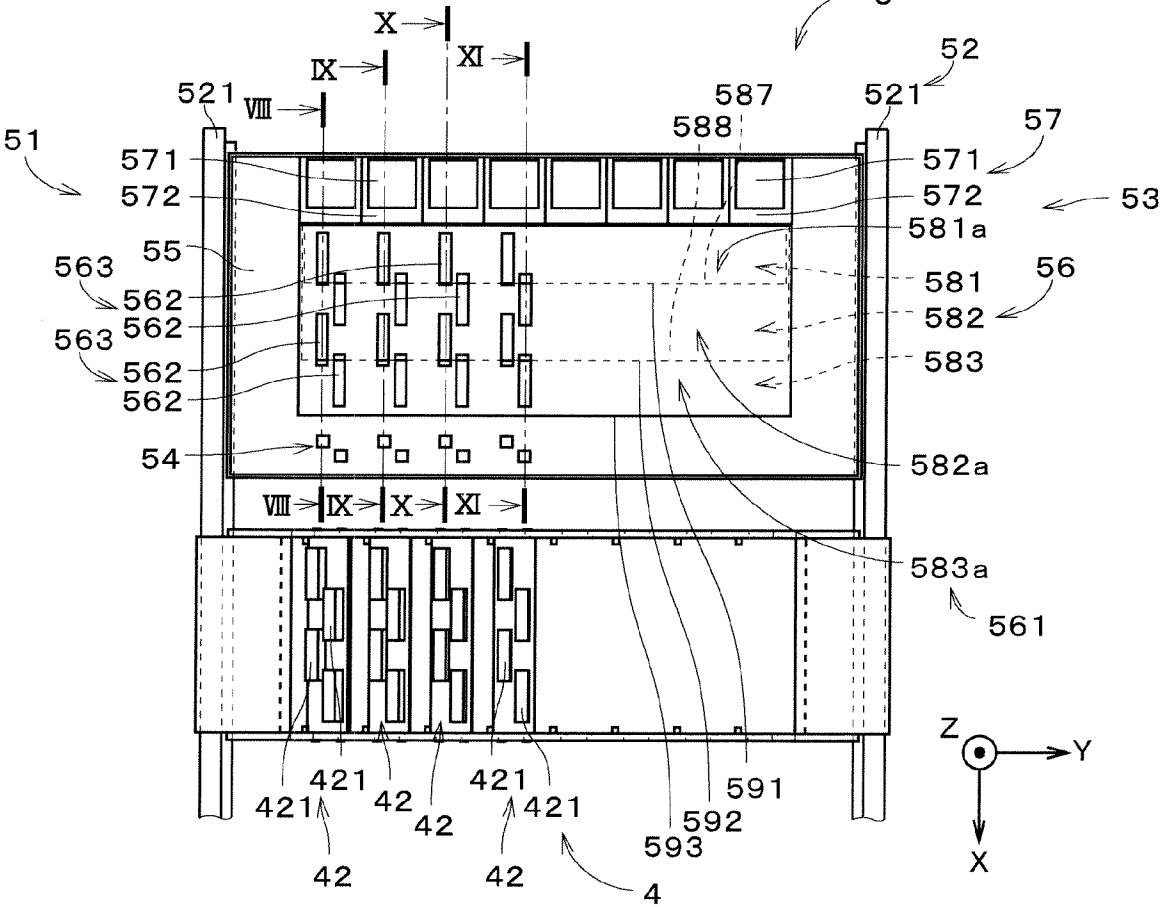
FIG. 6 is a plan view of the head unit and a maintenance part.
Figure 7:
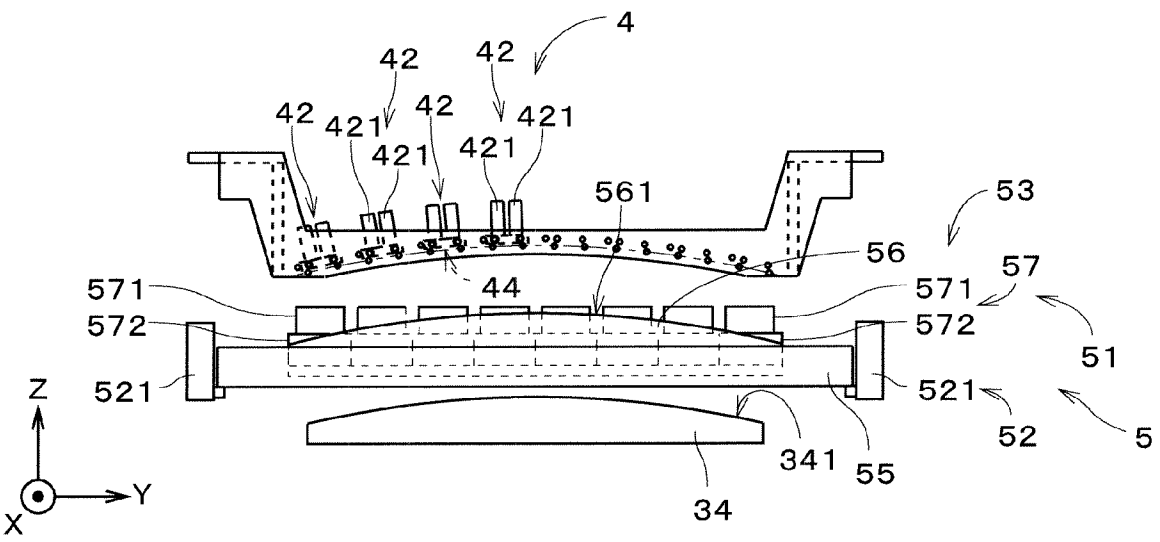
FIG. 7 is a front view of the head unit and the maintenance part.

FIG. 6 is a plan view of the head unit 4 and a maintenance part 5, and FIG. 7 is a front view of the head unit 4 and the maintenance part 5. FIG. 7 also shows the base material guiding part 34. FIGS. 6 and 7 shows a state in which the maintenance part 5 is located on the −X side of the head unit 4, and the head unit 4 is elevated by a head elevating mechanism (not shown) and disposed a great distance above the base material guiding part 34. The maintenance part 5 is located above the base material guiding part 34 (i.e., on the +Z side) and below the head unit 4.

The maintenance part 5 includes a maintenance unit 51 and a unit movement mechanism 52. The unit movement mechanism 52 moves the maintenance unit 51 in the X direction along guides 521 that extend in the X direction (i.e., the arrangement direction of the outlets of the head assemblies 42) below the head unit 4. During maintenance of the head unit 4, the maintenance unit 51 is moved from the position shown in FIG. 6 to the +X side and disposed under the head unit 4 (i.e., at a position between the head unit 4 and the base material guiding part 34). The maintenance of the head unit 4 involves operations for resolving clogging or the like of the outlets, such as purging in which pressure is applied to the flow path of ink so as to push the ink out of the outlets, spitting in which ink droplets are ejected periodically during standby before printing, and cleaning the ejection surface 44.

The maintenance unit 51 includes a cap part 53, a cleaning part 54, and a unit base 55. In FIG. 7, the cleaning part 54 is not shown. The unit base 55 has a substantially rectangular parallelepiped shape that has an open upper surface. The cap part 53 and the cleaning part 54 are disposed inside the unit base 55. The cap part 53 is configured to receive the liquid ejected from the head unit 4 (i.e., the ink ejected from the head assemblies 42) during maintenance such as the aforementioned purging or spitting. The cleaning part 54 is configured to clean the ejection surface 44 of the head unit 4.

The cap part 53 includes a liquid receiving part 56 and an exhaust part 57. During the maintenance of the head unit 4, the liquid receiving part 56 receives the ink ejected from the head unit 4 while vertically opposing the head unit 4. The liquid receiving part 56 has a substantially rectangular parallelepiped shape. Similarly to the guideway 341 of the base material guiding part 34, an upper surface 561 of the liquid receiving part 56 that opposes the head unit 4 is curved upward toward the head unit 4. When viewed from the front, the upper surface 561 of the liquid receiving part 56 has substantially the same shape as the guideway 341 of the base material guiding part 34. During maintenance, the upper surface 561 of the liquid receiving part 56 vertically opposes the ejection surface 44 of the head unit 4 with a predetermined gap therebetween (e.g., the upper surface 561 and the ejection surface 44 are approximately 2 to 3 mm apart from each other in the Z direction).

In the upper surface 561 of the liquid receiving part 56 are provided a plurality of openings 562. The upper surface 561 of the liquid receiving part 56 is a closed surface, except for the openings 562. In the present embodiment, no openings 562 are provided in a +Y-side half of the upper surface 561 of the liquid receiving part 56, and this +Y-side portion of the upper surface 561 is an entirely closed surface. In the −Y-side half of the upper surface 561 of the liquid receiving part 56 are provided 16 openings 562 that are disposed at positions that vertically oppose the head lower surfaces 425 (see FIG. 5) of the 16 ejection heads 421 during the maintenance of the head unit 4.

Specifically, in the upper surface 561 of the liquid receiving part 56, four openings 562 that correspond to the four ejection heads 421 of each head assembly 42 are arranged in a staggered configuration in the arrangement direction (the X direction), and assuming that these four openings 562 serve as a single opening row 563, four opening rows 563 are arranged in the movement direction (the Y direction). The ink ejected from the ejection heads 421 during the maintenance of the head unit 4 enters into the liquid receiving part 56 through the plurality of openings 562.

The exhaust part 57 is disposed laterally to the liquid receiving part 56. Specifically, the exhaust part 57 is disposed on only the −X side of the liquid receiving part 56. During the maintenance of the head unit 4, the exhaust part 57 is located adjacent to the −X side of the head unit 4. The exhaust part 57 includes a plurality of sets of a fan 571 and a manifold 572, the sets being arranged in the Y direction. In the present embodiment, eight manifolds 572 are fixed to the side surface on the −X side of the liquid receiving part 56, and a fan 571 is disposed on the +Z side of each of the manifolds 572. By driving the eight fans 571 of the exhaust part 57, the gas contained within the liquid receiving part 56 is evacuated from only the −X side of the liquid receiving part 56 (i.e., from only one side of the liquid receiving part 56) and exhausted to the outside of the liquid receiving part 56. When the exhaust part 57 exhausts a gas, the surrounding gas flows into the liquid receiving part 56 through the openings 562.

Figure 8:
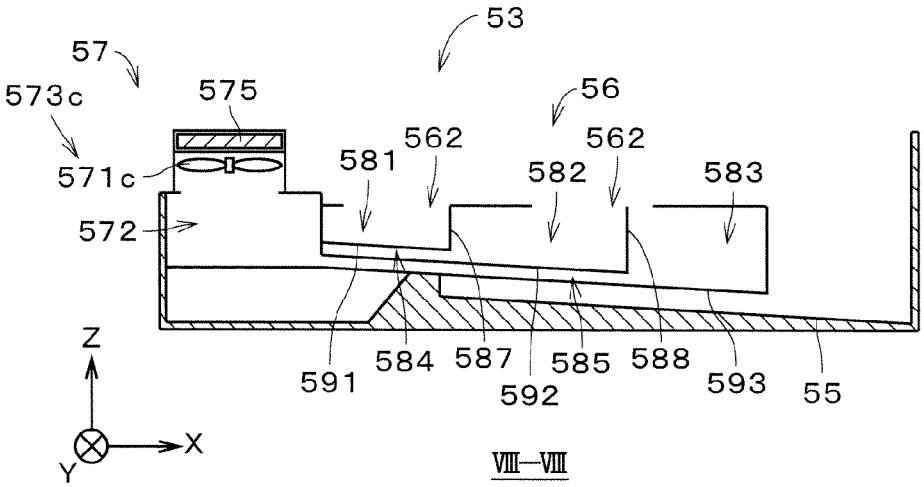
FIGS. 8 to 11 are cross-sectional views of a cap part.
Figure 9:
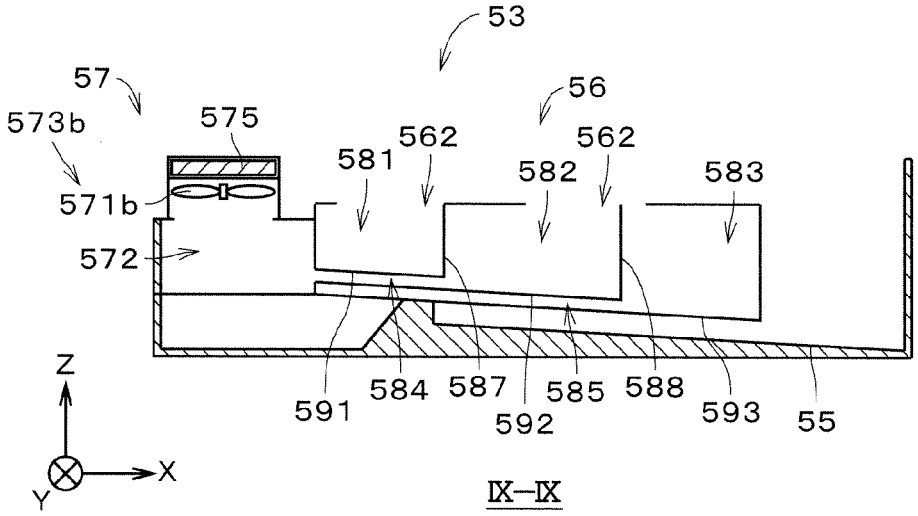
Figure 10:
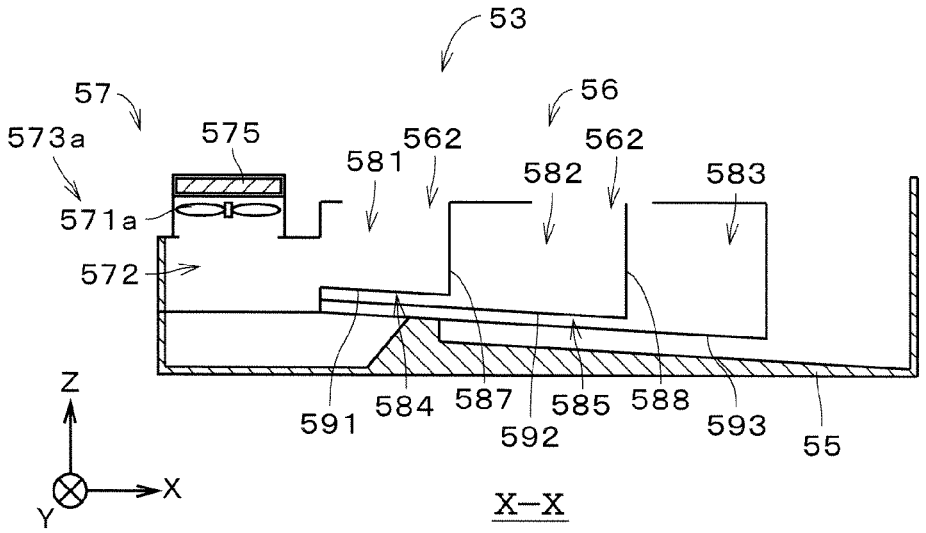
Figure 11:
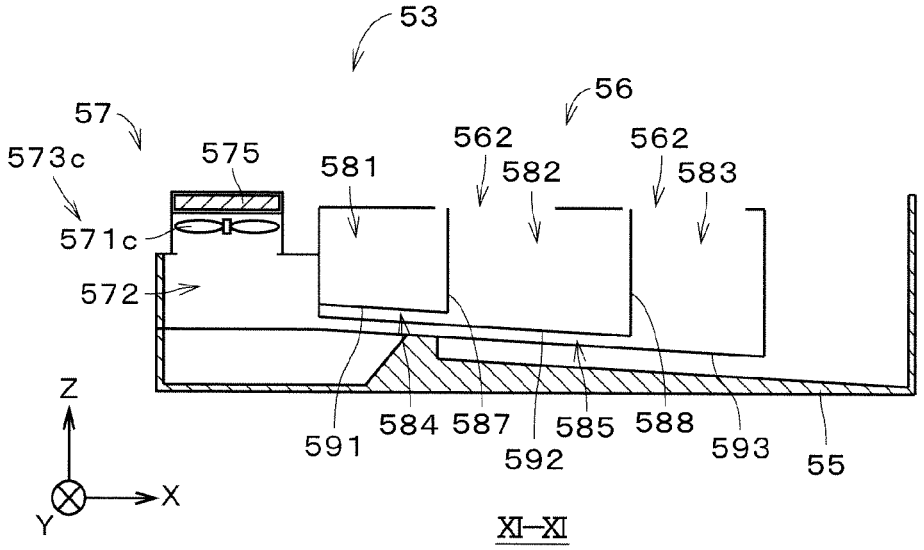

FIGS. 8 to 11 are cross-sectional views of the cap part 53 that are respectively taken along lines VIII-VIII, IX-IX, X-X, and XI-XI in FIG. 6. In FIGS. 8 to 11, the cross section of the unit base 55 is also shown, but the cleaning part 54 is not shown (the same applies to FIGS. 13 and 14). FIG. 8 shows a cross section that includes two openings 562 on the −Y side of the opening row 563 that is disposed furthest to the −Y side. FIG. 9 shows a cross section that includes two openings 562 on the −Y side of the opening row 563 that is the second opening row from the −Y side. FIG. 10 shows a cross section that includes two openings 562 on the −Y side of the opening row 563 that is the third opening row from the −Y side. FIG. 11 shows a cross section that includes two openings 562 on the +Y side of the opening row 563 that is disposed furthest to the +Y side.

As shown in FIGS. 6 and 8 to 11, the liquid receiving part 56 includes a first liquid receiving chamber 581, a second liquid receiving chamber 582, a third liquid receiving chamber 583, a flow path 584, and a flow path 585. The first liquid receiving chamber 581 is disposed adjacent to the +X side of the exhaust part 57. The second liquid receiving chamber 582 is disposed adjacent to the +X side of the first liquid receiving chamber 581 (i.e., the side of the first liquid receiving chamber 581 opposite the exhaust part 57). The third liquid receiving chamber 583 is disposed adjacent to the +X side of the second liquid receiving chamber 582. Accordingly, the second liquid receiving chamber 582 is disposed further from the exhaust part 57 in the X direction than is the first liquid receiving chamber 581. The third liquid receiving chamber 583 is disposed further from the exhaust part 57 in the X direction than is the first liquid receiving chamber 581 and the second liquid receiving chamber 582.

The first liquid receiving chamber 581, the second liquid receiving chamber 582, and the third liquid receiving chamber 583 are each a single continuous space that is long in the Y direction across substantially the entire length of the liquid receiving part 56. In other words, the first liquid receiving chamber 581, the second liquid receiving chamber 582, and the third liquid receiving chamber 583 are each provided to extend in the Y direction and to be located at a position that opposes the plurality of head assemblies 42 during maintenance. During maintenance, the first liquid receiving chamber 581, the second liquid receiving chamber 582, and the third liquid receiving chamber 583 receive the ink ejected from the head assemblies 42. The first liquid receiving chamber 581 and the second liquid receiving chamber 582 extend in the Y direction and are separated from each other by a first division wall 587 perpendicular to the X direction. The second liquid receiving chamber 582 and the third liquid receiving chamber 583 extend in the Y direction and are separated from each other by a second division wall 588 perpendicular to the X direction.

As shown in FIGS. 8 to 11, the flow path 584 is disposed on the −Z side of the first liquid receiving chamber 581 (i.e., below the first liquid receiving chamber 581). The flow path 585 is disposed on the −Z side of the second liquid receiving chamber 582 and the flow path 584. In other words, the flow path 584 is disposed without passing through (i.e. disposed so as to avoid) the first liquid receiving chamber 581, and the flow path 585 is disposed without passing through (i.e., disposed so as to avoid) the first liquid receiving chamber 581, the second liquid receiving chamber 582, and the flow path 584. The flow paths 584 and 585 are each a single thin space that is continuous across the entire length of the liquid receiving part 56 in the Y direction.

As shown in FIG. 9, the flow path 584 connects the second liquid receiving chamber 582 and the exhaust part 57. As shown in FIGS. 8 and 11, the flow path 585 connects the third liquid receiving chamber 583 and the exhaust part 57. The first liquid receiving chamber 581 is directly connected to the exhaust part 57 without passing through any flow path as shown in FIG. 10. In the following description, the flow path 584 connected to the second liquid receiving chamber 582 is referred to as a "second flow path 584," and the flow path 585 connected to the third liquid receiving chamber 583 is referred to as a "third flow path 585."

The first liquid receiving chamber 581 is connected to the third and sixth fans 571 from the −Y side via the third and sixth manifolds 572 from the −Y side among the eight manifolds 572 of the exhaust part 57 shown in FIG. 6. The second flow path 584 is connected to the second, fifth, and eighth fans 571 from the −Y side via the second, fifth, and eighth manifolds 572 from the −Y side. The third flow path 585 is connected to the first, fourth, and seventh fans 571 from the −Y side via the first, fourth, and seventh manifolds 572 from the −Y side.

In the following description, the fans 571 connected to the first liquid receiving chamber 581 are referred to as "first fans 571*a*," the fans 571 connected to the second liquid receiving chamber 582 are referred to as "second fans 571*b*," and the fans 571 connected to the third liquid receiving chamber 583 are referred to as "third fans 571*c*." The fans shown in FIGS. 8 to 11 are accordingly denoted by corresponding reference characters. If there is no particular need to distinguish among the first fans 571*a*, the second fans 571*b*, and the third fans 571*c*, they are also simply referred to as the "fans 571." As shown in FIGS. 8 to 11, on the +Z side of each of the fans 571 is provided a filter 575 for removing ink included in the gas exhausted from the fan 571. In the following description, the two first fans 571*a* are also collectively referred to as a "first fan part 573*a*." The three second fans 571*b* are also collectively referred to as a "second fan part 573*b*," and the three third fans 571*c* are also collectively referred to as a "third fan part 573*c*."

The first fan part 573*a* is connected to the first liquid receiving chamber 581 via the manifolds 572. By driving the two first fans 571*a* of the first fan part 573*a*, the gas contained within the first liquid receiving chamber 581 is evacuated. The second fan part 573*b* is connected to the second liquid receiving chamber 582 via the manifolds 572 and through the second flow path 584. By driving the three second fans 571*b* of the second fan part 573*b*, the gas contained within the second liquid receiving chamber 582 is evacuated. The third fan part 573*c* is connected to the third liquid receiving chamber 583 via the manifolds 572 and through the third flow path 585. By driving the three third fans 571*c* of the third fan part 573*c*, the gas contained within the third liquid receiving chamber 583 is evacuated.

In the cap part 53, the first liquid receiving chamber 581 is connected to the first fan part 573*a*, independently of the second liquid receiving chamber 582 and the third liquid receiving chamber 583. The second liquid receiving chamber 582 is connected to the second fan part 573*b*, independently of the first liquid receiving chamber 581 and the third liquid receiving chamber 583. The third liquid receiving chamber 583 is connected to the third fan part 573*c*, independently of the first liquid receiving chamber 581 and the second liquid receiving chamber 582.

As shown in FIGS. 6 and 8 to 10, out of the two openings 562 on the −Y side of each opening row 563, the opening 562 on the +X side is provided across the second division wall 588 and is shared by the second liquid receiving chamber 582 and the third liquid receiving chamber 583. Specifically, the second liquid receiving chamber 582 includes most of that opening 562 on the −X side, and the third liquid receiving chamber 583 includes the remaining portion of the opening 562 on the +X side. Out of the two openings 562 on the −Y side of each opening row 563, the opening 562 on the −X side is provided on the −X side of the first division wall 587 and is included in the first liquid receiving chamber 581.

As shown in FIGS. 6 and 11, out of the two openings 562 on the +Y side of each opening row 563, the opening 562 on the +X side is provided across the second division wall 588 and is shared by the second liquid receiving chamber 582 and the third liquid receiving chamber 583. Specifically, the third liquid receiving chamber 583 includes most of that opening 562 on the +X side, and the second liquid receiving chamber 582 includes the remaining portion of the opening 562 on the −X side. Out of the two openings 562 on the +Y side of each opening row 563, the opening 562 on the −X side is provided across the first division wall 587 and is shared by the first liquid receiving chamber 581 and the second liquid receiving chamber 582. Specifically, the second liquid receiving chamber 582 includes most of that opening 562 on the +X side, and the first liquid receiving chamber 581 includes the remaining portion of the opening 562 on the −X side.

In the liquid receiving part 56 shown in FIG. 6, the first liquid receiving chamber 581 includes −X-side portions of the four openings 562 that are the third openings 562 of the respective opening rows 563 from the +X side, and the four openings 562 of the respective opening rows 563 that are located furthest to the −X side, as eight first openings that oppose a portion of the head unit 4 during maintenance. An upper surface 581*a* in which the first openings of the first liquid receiving chamber 581 are provided (i.e., a −X-side portion of the upper surface 561 of the liquid receiving part 56) is a closed surface, except for the first openings.

The second liquid receiving chamber 582 includes −X-side portions of the four openings 562 of the respective opening rows 563 that are located furthest to the +X side, −X-side portions of the four openings 562 that are the second openings 562 of the respective opening rows 563 from the +X side, and +X-side portions of the four openings 562 that are the third openings 562 of the respective opening rows 563 from the +X side, as 12 second openings that oppose another portion of the head unit 4 during maintenance. An upper surface 582*a* in which the second openings of the second liquid receiving chamber 582 are provided (i.e., a central portion of the upper surface 561 of the liquid receiving part 56 in the X direction) is a closed surface, except for the second openings.

The third liquid receiving chamber 583 includes +X-side portions of the four openings 562 of the respective opening rows 563 that are located furthest to the +X side, and +X-side portions of the four openings 562 that are the second openings 562 of the respective opening rows 563 from the +X side, as eight third openings that oppose another portion of the head unit 4 during the maintenance of the head unit 4. An upper surface 583*a* in which the third openings of the third liquid receiving chamber 583 are provided (i.e., a +X-side portion of the upper surface 561 of the liquid receiving part 56) is a closed surface, except for the third openings.

As described above, the plurality of openings 562 of the liquid receiving part 56 vertically oppose the plurality of head lower surfaces 425, which are outlet existence regions, during maintenance. Accordingly, during maintenance, the first openings of the first liquid receiving chamber 581 vertically oppose some of the outlet existence regions. The second openings of the second liquid receiving chamber 582 vertically oppose some other outlet existence regions, and the third openings of the third liquid receiving chamber 583 vertically oppose some other outlet existence regions.

In the present embodiment, the liquid receiving part 56 is constituted by a first container 591, a second container 592, and a third container 593 as shown in FIGS. 6 and 8 to 11. The first container 591, the second container 592, and the third container 593 are each in the shape of a substantially rectangular parallelepiped that is long in the Y direction, and they have substantially the same length in the Y direction. The X-direction width of the second container 592 is greater than that of the first container 591. The X-direction width of the third container 593 is greater than that of the second container 592. The first container 591 is disposed inside the second container 592 and is leaning to the −X side. The second container 592 is disposed inside the third container 593 and is leaning to the −X side.

In the liquid receiving part 56, the first container 591 serves as the aforementioned first liquid receiving chamber 581. On the +X side of the first container 591 (i.e., on the opposite side of the first container 591 from the exhaust part 57), the second liquid receiving chamber 582 is located between the first container 591 and the second container 592. On the +X side of the second container 592, the third liquid receiving chamber 583 is located between the second container 592 and the third container 593. The side wall on the +X side of the first container 591 serves as the first division wall 587, and the side wall on the +X side of the second container 592 serves as the second division wall 588.

As shown in FIGS. 8 to 11, the gap between the bottom surface of the first container 591 and the bottom surface of the second container 592 forms the second flow path 584, and the gap between the bottom surface of the second container 592 and the bottom surface of the third container 593 forms the third flow path 585. The bottom surface of the first container 591, the bottom surface of the second container 592, and the bottom surface of the third container 593 are each an inclined surface that is inclined to the −Z side toward the +X side. In other words, the bottom surface of the first liquid receiving chamber 581, the bottom surface of the second flow path 584, the bottom surface of the second liquid receiving chamber 582, the bottom surface of the third flow path 585, and the bottom surface of the third liquid receiving chamber 583 are inclined surfaces that are inclined downward away from the exhaust part 57.

The ink ejected from the head unit 4 toward the first liquid receiving chamber 581 accordingly flows to the +X side on the bottom surface of the first liquid receiving chamber 581. The first container 591 has a slit opening at its bottom on the +X side, so that the ink in the first liquid receiving chamber 581 flows through this opening to the second container 592. The ink that has flowed from the first container 591 to the second container 592 and the ink ejected from the head unit 4 toward the second liquid receiving chamber 582 flow to the +X side on the bottom surface of the second liquid receiving chamber 582. The second container 592 also has a slit opening at its bottom on the +X side, so that the ink in the second liquid receiving chamber 582 flows through this opening to the third container 593.

The ink that has flowed from the second container 592 to the third container 593 and the ink ejected from the head unit 4 toward the third liquid receiving chamber 583 flow to the +X side on the bottom surface of the third liquid receiving chamber 583. The third container 593 also has a slit opening at its bottom on the +X side, so that the ink in the third container 593 flows through this opening to the unit base 55. The inner bottom surface of the unit base 55 is also an inclined surface that is inclined to the −Z side toward the +X side. Thus, the ink on the inner bottom surface of the unit base 55 flows to the +X side and is discharged to the outside by an ink discharging part provided at the bottom on the +X side of the unit base 55.

As described above, in the inkjet printer 1, the cap part 53 for receiving ink from the head unit 4 during maintenance includes the liquid receiving part 56 and the exhaust part 57. Because, in the cap part 53, the exhaust part 57 is disposed laterally to the liquid receiving part 56 (on the −X side of the liquid receiving part 56), the exhaust part 57 can be disposed with ease as compared to the case where exhaust parts are provided on multiple side surfaces of the liquid receiving part 56. This also suppresses an increase in the sizes of the maintenance part 5 and the inkjet printer 1.

As described above, in the liquid receiving part 56, the second liquid receiving chamber 582 is disposed further from the exhaust part 57 than is the first liquid receiving chamber 581, and the third liquid receiving chamber 583 is disposed further from the exhaust part 57 than are the first liquid receiving chamber 581 and the second liquid receiving chamber 582. The second flow path 584 is disposed without passing through the first liquid receiving chamber 581, and the third flow path 585 is disposed without passing through the first liquid receiving chamber 581 and the second liquid receiving chamber 582. In the exhaust part 57, the first fan part 573*a* is connected to the first liquid receiving chamber 581. Accordingly, the gas in the first liquid receiving chamber 581 can be appropriately exhausted, independently of the second liquid receiving chamber 582 and the third liquid receiving chamber 583. The second fan part 573*b* is connected to the second liquid receiving chamber 582 through the second flow path 584. Accordingly, it is possible to appropriately exhaust the gas in the second liquid receiving chamber 582, which is further from the exhaust part 57 than is the first liquid receiving chamber 581, independently of the first liquid receiving chamber 581 and the third liquid receiving chamber 583. Consequently, a mist (e.g., an ink mist) in the liquid receiving part 56 can be discharged efficiently.

In the exhaust part 57, the third fan part 573*c* is connected to the third liquid receiving chamber 583 through the third flow path 585. Accordingly, it is possible to appropriately exhaust the gas in the third liquid receiving chamber 583, which is further from the exhaust part 57 than are the first liquid receiving chamber 581 and the second liquid receiving chamber 582, independently of the first liquid receiving chamber 581 and the second liquid receiving chamber 582. Consequently, the mist in the liquid receiving part 56 can be discharged more efficiently.

In the liquid receiving part 56, the upper surface 581*a* of the first liquid receiving chamber 581, the upper surface 582*a* of the second liquid receiving chamber 582, and the upper surface 583*a* of the third liquid receiving chamber 583 are all closed surfaces, except for the openings 562. This allows the first fan part 573*a* to efficiently evacuate the gas contained within the first liquid receiving chamber 581. Consequently, the first liquid receiving chamber 581 can be ventilated efficiently. Similarly, it is possible to efficiently evacuate the gas contained within the second liquid receiving chamber 582 and the third liquid receiving chamber 583 and to thereby efficiently ventilate the second liquid receiving chamber 582 and the third liquid receiving chamber 583.

In the liquid receiving part 56, the first liquid receiving chamber 581, the second liquid receiving chamber 582, and the third liquid receiving chamber 583 are each provided across the plurality of head assemblies 42 and each receive the ink ejected from the head assemblies 42 during maintenance. This simplifies the structure of the liquid receiving part 56. In addition, the bottom surface of the first liquid receiving chamber 581, the bottom surface of the second liquid receiving chamber 582, and the bottom surface of the third liquid receiving chamber 583 are each an inclined surface that is inclined downward away from the exhaust part 57. Accordingly, the liquid ink received in the first liquid receiving chamber 581, the second liquid receiving chamber 582, and the third liquid receiving chamber 583 can be led in a direction away from the exhaust part 57 with a simple structure.

In the liquid receiving part 56, the second container 592 is disposed inside the third container 593, and the first container 591 is disposed inside the second container 592. This facilitates the formation of the first liquid receiving chamber 581, the second liquid receiving chamber 582, the third liquid receiving chamber 583, the second flow path 584, and the third flow path 585 and also simplifies the structure of the liquid receiving part 56. By using the gap between the bottom surface of the first container 591 and the bottom surface of the second container 592 as the second flow path 584, the second liquid receiving chamber 582 and the exhaust part 57 can be easily connected to each other without passing through the first liquid receiving chamber 581. Also, by using the gap between the bottom surface of the second container 592 and the bottom surface of the third container 593 as the third flow path 585, the third liquid receiving chamber 583 and the exhaust part 57 can be easily connected to each other without passing through the first liquid receiving chamber 581 and the second liquid receiving chamber 582.

Figure 12:
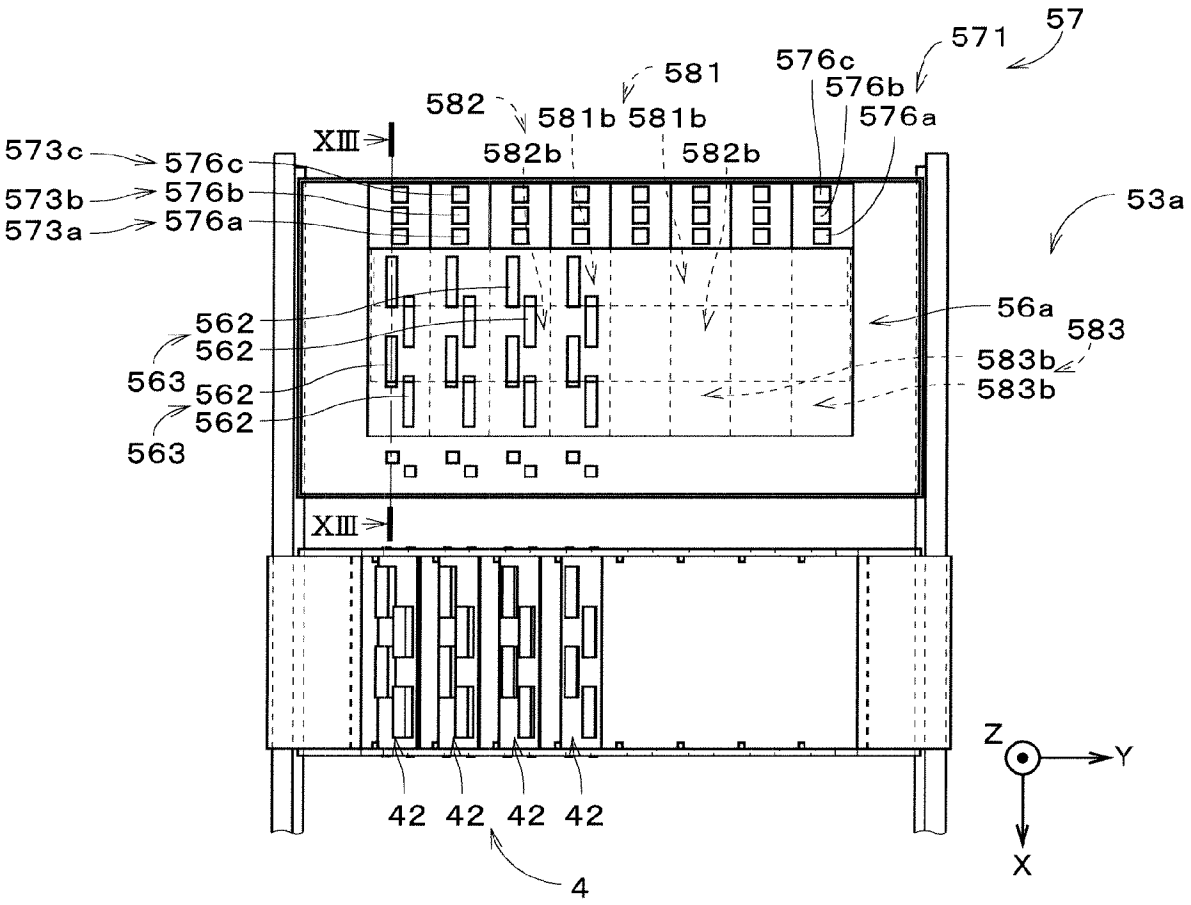
FIG. 12 is a plan view of a head unit and a maintenance part that includes another liquid receiving part.

The inkjet printer 1 may be configured such that, as shown in FIG. 12, a cap part 53*a* includes, instead of the liquid receiving part 56 shown in FIG. 6, a liquid receiving part 56*a* having a different structure from the liquid receiving part 56. The liquid receiving part 56*a* is provided with seven division walls that are arranged in the Y direction within a first liquid receiving chamber 581, and the first liquid receiving chamber 581 is divided into eight first small chambers 581*b* arranged in the Y direction. The seven division walls are each in the shape of a flat plate substantially perpendicular to the Y direction and are each located at a position in the Y direction between two adjacent fans 571 of the exhaust part 57. The eight first small chambers 581*b* are separated from one another by the division walls and are respectively independently connected to the eight fans 571. In other words, each of the first small chambers 581*b* is connected to the fan 571 disposed adjacent to the −X side of the first small chamber 581*b*, independently of the other first small chambers 581*b*.

Figure 13:
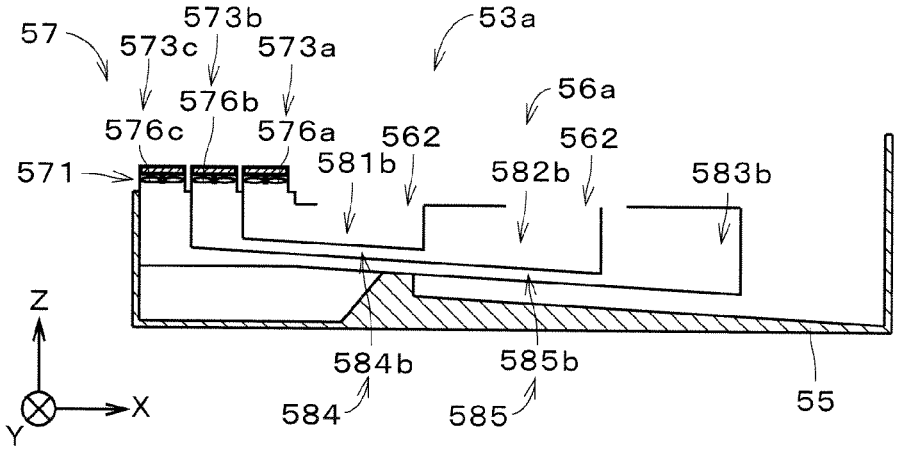
FIG. 13 is a cross-sectional view of a cap part.

FIG. 13 is a cross-sectional view of the cap part 53*a* shown in FIG. 12, taken along line XIII-XIII. As shown in FIGS. 12 and 13, each of the fans 571 includes a first fan 576*a*, a second fan 576*b*, and a third fan 576*c* arranged in the X direction. In the following description, in order to clearly distinguish these fans from the first fans 571*a*, the second fans 571*b*, and the third fans 571*c*, which have been described above, the first fans 576*a*, the second fans 576*b*, and the third fans 576*c* are respectively referred to as "first small fans 576*a*," "second small fans 576*b*," and "third small fans 576*c*." The first small fans 576*a* that are disposed furthest to the +X side of the respective fans 571 are respectively connected to the first small chambers 581*b*, independently of the second small fans 576*b* and the third small fans 576*c*.

Similarly to the first liquid receiving chamber 581, the second liquid receiving chamber 582 is also divided into eight second small chambers 582*b* that are arranged in the Y direction and are separated from one another by division walls. The second flow path 584 is also divided into eight second small flow paths 584*b* that are arranged in the Y direction and are separated from one another by division walls. Each of the second small chambers 582*b* is connected, without passing through the first small chamber 581*b* adjacent to the −X side, to the fan 571 disposed adjacent to the −X side of that first small chamber 581*b* through a second small flow path 584*b*. Each of the second small chambers 582*b* is connected to the fan 571, independently of the other second small chambers 582*b*. Specifically, the second small fan 576*b* that is disposed in the center of each fan 571 is connected to the second small chamber 582*b*, independently of the first small fan 576*a* and the third small fan 576*c*.

Similarly to the first liquid receiving chamber 581 and the second liquid receiving chamber 582, the third liquid receiving chamber 583 is also divided into eight third small chambers 583*b* that are arranged in the Y direction and are separated from one another by division walls. The third flow path 585 is also divided into eight third small flow paths 585*b* that are arranged in the Y direction and are separated from one another by division walls. Each of the third small chambers 583*b* is connected, without passing through the second small chamber 582*b* adjacent to the −X side and the first small chamber 581*b* adjacent to the −X side of that second small chamber 582*b*, to the fan 571 adjacent to the −X side of that first small chamber 581*b* through a third small flow path 585*b*. Each of the third small chambers 583*b* is connected to the fan 571, independently of the other third small chambers 583*b*. Specifically, the third small fan 576*c* that is disposed furthest to the −X side of each fan 571 is connected to the third small chamber 583*b*, independently of the first small fan 576*a* and the second small fan 576*b*.

If a plurality of fans connected to the first liquid receiving chamber 581 are collectively referred to as a "first fan part 573*a*" as described above, the first fan part 573*a* includes the eight first small fans 576*a* that are respectively independently connected to the eight first small chambers 581*b*. The second fan part 573*b* connected to the second liquid receiving chamber 582 includes the eight second small fans 576*b* that are respectively independently connected to the eight second small chambers 582*b*. The third fan part 573*c* connected to the third liquid receiving chamber 583 includes the eight third small fans 576*c* that are respectively independently connected to the eight third small chambers 583*b*.

During the maintenance of the head unit 4, among the eight first small chambers 581*b* of the first liquid receiving chamber 581, the four first small chambers 581*b* on the −Y side vertically oppose a portion of the four head assemblies 42. Also, among the eight second small chambers 582*b* of the second liquid receiving chamber 582, the four second small chambers 582*b* on the −Y side vertically oppose another portion of the above four head assemblies 42. Moreover, among the eight third small chambers 583*b* of the third liquid receiving chamber 583, the four third small chambers 583*b* on the −Y side vertically oppose yet another portion of the above four head assemblies 42.

If a set of a single first small chamber 581*b*, a single second small chamber 582*b*, and a single third small chamber 583*b* that are adjacent in the X direction are collectively referred to as a "small chamber row," each small chamber row is provided with a single opening row 563 (i.e., four openings 562) as described above. The ink ejected from the four head assemblies 42 during maintenance is received by the first, second, and third small chambers 581*b*, 582*b*, and 583*b* that vertically oppose the head assemblies 42, i.e., received by the four small chamber rows on the −Y side. Among the eight fans 571 of the exhaust part 57, the first small fans 576*a*, the second small fans 576*b*, and the third small fans 576*c* of the four fans 571 on the −Y side are driven so that the gas contained within the four first small chambers 581*b*, the four second small chambers 582*b*, and the four third small chambers 583*b* on the −Y side is evacuated and exhausted to the outside.

In the cap part 53*a* shown in FIG. 12, as described above, each of the first small chambers 581*b* is connected to a first small fan 576*a*, independently of the other first small chambers 581*b*, the second small chambers 582*b*, and the third small chambers 583*b*. Accordingly, it is possible to efficiently exhaust the gas contained within each of the first small chambers 581*b*. Also, each of the second small chambers 582*b* is connected to a second small fan 576*b*, independently of the first small chambers 581*b*, the other second small chambers 582*b*, and the third small chambers 583*b*. Accordingly, it is possible, as in the case of the first small chambers 581*b*, to appropriately exhaust the gas contained within each of the second small chambers 582*b*, which are disposed further from the exhaust part 57 than is the first small chambers 581*b*. Consequently, the mist (e.g., the ink mist) in the liquid receiving part 56 can be discharged efficiently.

Also, each of the third small chambers 583*b* is connected to a third small fan 576*c*, independently of the first small chambers 581*b*, the second small chambers 582*b*, and the other third small chambers 583*b*. Accordingly, it is possible, as in the case of the first small chambers 581*b* and the second small chambers 582*b*, to appropriately exhaust the gas contained within each of the third small chambers 583*b*, which are disposed further from the exhaust part 57 than are the first small chambers 581*b* and the second small chambers 582*b*. Consequently, the mist in the liquid receiving part 56 can be discharged more efficiently.

Figure 14:
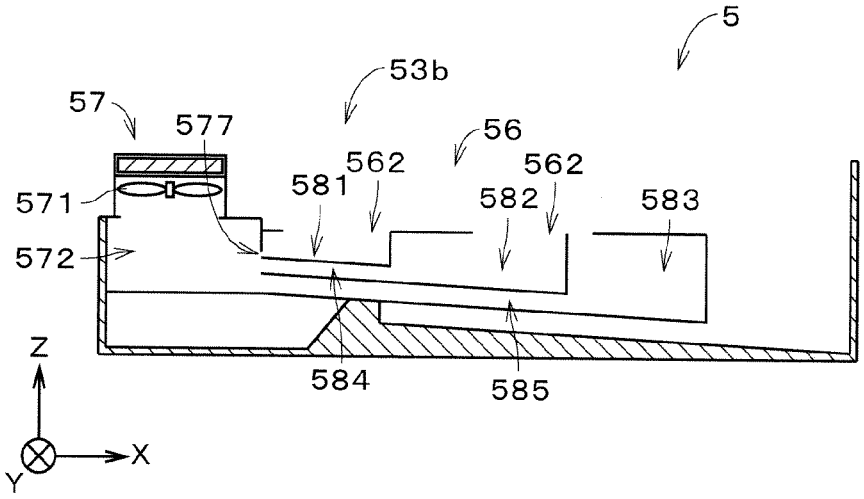
FIG. 14 is a cross-sectional view of a cap part of an inkjet printer according to a second embodiment.

FIG. 14 is a cross-sectional view of a maintenance part 5 of an inkjet printer according to a second embodiment of the present invention. In a cap part 53*b* shown in FIG. 14, a liquid receiving part 56 and an exhaust part 57 are connected in a different form from that shown in FIGS. 8 to 11. The other structure of the cap part 53*b* is the same as that of the cap part 53 shown in FIG. 6, and thus in the following description, corresponding constituent elements are denoted by the same reference numerals.

As shown in FIG. 14, in the cap part 53*b*, each fan 571 of the exhaust part 57 is connected to a first liquid receiving chamber 581, a second liquid receiving chamber 582, and a third liquid receiving chamber 583. Each fan 571 is connected to the first liquid receiving chamber 581 through a manifold 572 and is connected to the second liquid receiving chamber 582 through the manifold 572 and a second flow path 584. Each fan 571 is also connected to the third liquid receiving chamber 583 through the manifold 572 and a third flow path 585.

In the cap part 53*b*, eight fans 571 of the exhaust part 57 are driven so as to evacuate the gas contained within the first liquid receiving chamber 581, the second liquid receiving chamber 582 and the third liquid receiving chamber 583. By the exhaust part 57 evacuating the gas, the mist in the first liquid receiving chamber 581, the mist in the second liquid receiving chamber 582, and the mist in the third liquid receiving chamber 583 are discharged together with the gas. In this way, the cap part 53*b* can appropriately exhaust the gas contained within the second liquid receiving chamber 582 and the third liquid receiving chamber 583, which are disposed further from the exhaust part 57, as in the case of the first liquid receiving chamber 581. Consequently, the mist (e.g., the ink mist) in the liquid receiving part 56 can be discharged efficiently.

In the cap part 53*b*, the area of an opening 577 located between the first liquid receiving chamber 581 and the manifold 572 is smaller than the cross-sectional area of the second flow path 584 (i.e., the area of a cross section that is perpendicular to a direction from the second liquid receiving chamber 582 to the manifold 572). Also, the cross-sectional area of the second flow path 584 is smaller than that of the third flow path 585. This makes substantially equal a pressure loss to be caused in the gas in the third liquid receiving chamber 583 before reaching the fans 571, a pressure loss to be caused in the gas in the second liquid receiving chamber 582 before reaching the fans 571, and a pressure loss to be caused in the gas in the first liquid receiving chamber 581 before reaching the fans 571. Accordingly, the inlet velocity of the gas flowing from the openings 562 into the first liquid receiving chamber 581, the inlet velocity of the gas flowing from the openings 562 into the second liquid receiving chamber 582, and the inlet velocity of the gas flowing from the openings 562 into the third liquid receiving chamber 583 become substantially the same. As a result, by the exhaust part 57 evacuating a gas, the mist in the first liquid receiving chamber 581, the mist in the second liquid receiving chamber 582, and the mist in the third liquid receiving chamber 583 are discharged similarly. Consequently, the mist in the liquid receiving part 56 can be discharged more efficiently.

In the cap part 53*b*, the first liquid receiving chamber 581, the second liquid receiving chamber 582, and the third liquid receiving chamber 583 may be each divided into a plurality of small chambers arranged in the Y direction as in the case of the cap part 53*a* shown in FIG. 12. In this case, each fan 571 is provided with only a single fan, and a set of a single first small chamber, a single second small chamber, and a single third small chamber arranged in the X direction is connected to that fan. Also in this case, the mist in the liquid receiving part 56 can be discharged efficiently as described above.

The inkjet printer described above can be modified in various ways.

In the inkjet printer 1 described above, if the mounting positions of the head assemblies 42 of the head unit 4 are changed, the positions of the openings 562 of the liquid receiving part 56 are also changed to positions that oppose the head assemblies 42 during maintenance. If the number of head assemblies 42 provided in the head unit 4 is changed, the number and positions of openings 562 are also appropriately changed.

In the liquid receiving part 56, the second flow path 584 does not necessarily have to be disposed on the −Z side of the first liquid receiving chamber 581 as long as it is disposed without passing through the first liquid receiving chamber 581. For example, a configuration is possible in which the Y-direction length of the first container 591 is shorter than that of the second container 592, and second flow paths 584 are provided on the +Y and −Y sides of the first liquid receiving chamber 581. Alternatively, the gap between the bottom surface of the first container 591 and the bottom surface of the second container 592 and the gaps between the side surfaces of the first container 591 and the side surfaces of the second container 592 on the +Y and −Y sides of the first container 591 may be used as the second flow path 584. In this case, the gap between the bottom surface of the first container 591 and the bottom surface of the second container 592 is included in the second flow path 584. The same applies to the third flow path 585.

The inkjet printer 1 may be configured such that the maintenance unit 51 is fixed at a predetermined position, and during the maintenance of the head unit 4, the head unit 4 is moved in the X direction to a position vertically opposing the cap part 53.

Depending on the design of the inkjet printer 1, a conveying mechanism for moving the head unit 4 in the movement direction may be provided. Specifically, it is sufficient that the base material 9 and the head unit 4 move relative to each other in the movement direction. Also, a rotation mechanism in which the base material 9 is held on the outer circumferential surface of a substantially cylindrical drum, and the drum is rotated at a position opposing the head unit 4 may be provided as a conveying mechanism. In such an inkjet printer, for example, the head unit 4 may be disposed laterally to the drum, and the head unit 4 may eject ink toward the base material 9 in a substantially horizontal direction.

The inkjet printer 1 may use ink that is cured by irradiation with radiation (e.g., infrared rays or electron rays) other than UV rays. If the inkjet printer 1 uses ink that does not require irradiation with radiation, the curing part 35 may be omitted. The guideway 341 of the base material guiding part 34 does not necessarily have to be a curved surface, and it may be a flat surface. In this case, the head assemblies 42 are all disposed at the same position in the Z direction, and the upper surface 561 of the liquid receiving part 56 is also a flat surface.

The inkjet printer 1 may be configured to form an image on a sheet base material. For example, in an inkjet printer that holds a base material on its stage, a head unit moves relative to the stage in a scanning direction parallel to the stage (performs main scanning) while ejecting ink, then when having reached the end of the base material, moves relative to the stage by a predetermined distance in a movement direction that is parallel to the stage and that is perpendicular to the scanning direction (performs sub-scanning), and then moves relative to the stage in a direction opposite the direction of the previous main scanning while ejecting ink. In this way, the inkjet printer described above (so-called a "shuttle type printer") forms an image onto the base material by the head unit performing main scanning on the base material and intermittently performing sub-scanning in the width direction each time the main scanning has been finished.

An object on which the inkjet printer 1 forms an image may be a base material 9 other than paper. For example, the inkjet printer 1 may form an image onto a plate- or sheet-like base material 9 formed of plastic or the like.

The structures of the head unit 4 and the cap part 53 described above may be applied to liquid ejection apparatuses other than inkjet printers (e.g., apparatuses for continuously ejecting and applying a material with fluidity, which includes an organic electroluminescent material, toward a base material such as a glass substrate). Also, a conveying mechanism for moving a base material may be provided independently of a liquid ejection apparatus.

The configurations of the embodiments and variations described above may be appropriately combined as long as there are no mutual inconsistencies.

While the invention has been shown and described in detail, the foregoing description is in all aspects illustrative and not restrictive. It is therefore to be understood that numerous modifications and variations can be devised without departing from the scope of the invention. This application claims priority benefit under 35 U.S.C. Section 119 of Japanese Patent Application No. 2013-049886 filed in the Japan Patent Office on Mar. 13, 2013, the entire disclosure of which is incorporated herein by reference.

REFERENCE SIGNS LIST

1 Inkjet printer
4 Head unit
9 Base material
42 Head assembly
44 Ejection surface
53, 53*a*, 53*b* Cap part
56, 56*a* Liquid receiving part
57 Exhaust part
562 Opening
573*a* First fan part
573*b* Second fan part
576*a* First small fan
576*b* Second small fan
581 First liquid receiving chamber
581*a* Upper surface (of first liquid receiving chamber)
581*b* First small chamber
582 Second liquid receiving chamber
582*a* Upper surface (of second liquid receiving chamber)
582*b* Second small chamber
584 Second flow path
591 First container
592 Second container

The invention claimed is:

1. A liquid ejection apparatus comprising;

an ejecting part for ejecting a liquid toward a base material, said ejecting part and said base material moving relative to each other in a predetermined movement direction; and a cap part for receiving the liquid ejected from said ejecting part during maintenance, said cap part including;

a liquid receiving part for receiving the liquid ejected from said ejecting part while facing said ejecting part during maintenance; and an exhaust part disposed laterally to said liquid receiving part and for evacuating a gas contained within said liquid receiving part, said liquid receiving part including:

a first liquid receiving chamber having an opening opposing a portion of said ejecting part;

a second liquid receiving chamber disposed further from said exhaust part than is said first liquid receiving chamber, separated from said first liquid receiving chamber by a division wall, and having an opening opposing another portion of said ejecting part; and a flow path disposed without passing through said first liquid receiving chamber, and connecting said second liquid receiving chamber and said exhaust part, and said exhaust part including:

a first fan part connected to said first liquid receiving chamber and for evacuating a gas contained within said first liquid receiving chamber; and a second fan part connected to said second liquid receiving chamber through said flow path and for evacuating a gas contained within said second liquid receiving chamber, wherein a bottom surface of said first liquid receiving chamber and a bottom surface of said second liquid receiving chamber are each an inclined surface that is inclined downward away from said exhaust part.

2. The liquid ejection apparatus according to claim 1, wherein said ejecting part includes a plurality of head parts arranged in said movement direction, said first liquid receiving chamber includes a plurality of first small chambers that respectively oppose said plurality of head parts during maintenance and that are separated from one another by division walls, said second liquid receiving chamber includes a plurality of second small chambers that respectively oppose said plurality of head parts during maintenance and that are separated from one another by division walls, said first fan part includes a plurality of first fans that are respectively connected to said plurality of first small chambers, and said second fan part includes a plurality of second fans that are respectively connected to said plurality of second small chambers.

3. The liquid ejection apparatus according to claim 2, wherein a surface in which said opening of said first liquid receiving chamber is provided is a closed surface, except for said opening, and a surface in which said opening of said second liquid receiving chamber is provided is a closed surface, except for said opening.

4. The liquid ejection apparatus according to claim 3, wherein said ejecting part ejects fine droplets of ink.

5. The liquid ejection apparatus according to claim 1, comprising:

a box-shaped first container; and a box-shaped second container in which said first container is located, wherein said first container serves as said first liquid receiving chamber, said second liquid receiving chamber is located between said second container and said first container, on an opposite side of said first container from said exhaust part, and a gap between a bottom surface of said first container and a bottom surface of said second container is included in said flow path.

6. The liquid ejection apparatus according to claim 1, wherein said ejecting part includes a plurality of head parts arranged in said movement direction, and said first liquid receiving chamber and said second liquid receiving chamber are each long in said movement direction and provided across said plurality of head parts, and each receive a liquid ejected from said plurality of head parts during maintenance.

7. The liquid ejection apparatus according to claim 6, wherein a surface in which said opening of said first liquid receiving chamber is provided is a closed surface, except for said opening, and a surface in which said opening of said second liquid receiving chamber is provided is a closed surface, except for said opening.

8. The liquid ejection apparatus according to claim 7, wherein said ejecting part ejects fine droplets of ink.

9. The liquid ejection apparatus according to claim 1, wherein a surface in which said opening of said first liquid receiving chamber is provided is a closed surface, except for said opening, and a surface in which said opening of said second liquid receiving chamber is provided is a closed surface, except for said opening.

10. The liquid ejection apparatus according to claim 1, wherein said ejecting part ejects fine droplets of ink.

11. A liquid ejection apparatus comprising:

an an ejecting part for ejecting a liquid toward a base material, said ejecting part and said base material moving relative to each other in a predetermined movement direction; and a cap part for receiving the liquid ejected from said ejecting part during maintenance, said cap part including:

a liquid receiving part for receiving the liquid elected from said ejecting part while facing said electing part during maintenance; and an exhaust part disposed laterally to said liquid receiving part and for evacuating a gas contained within said liquid receiving part, said liquid receiving part including:

a first liquid receiving chamber having an opening opposing a portion of said ejecting part;

a second liquid receiving chamber disposed further from said exhaust part than is said first liquid receiving chamber, separated from said first liquid receiving chamber by a division wall, and having an opening opposing another portion of said ejecting part; and a flow path disposed without passing through said first liquid receiving chamber, and connecting said second liquid receiving chamber and said exhaust part, and by said exhaust part evacuating a gas, a mist contained in said first liquid receiving chamber and a mist contained in said second liquid receiving chamber are discharged together with the gas; wherein a bottom surface of said first liquid receiving chamber and a bottom surface of said second liquid receiving chamber are each an inclined surface that is inclined downward away from said exhaust part.

12. The liquid ejection apparatus according to claim 11, comprising:

a box-shaped first container; and a box-shaped second container in which said first container is located, wherein said first container serves as said first liquid receiving chamber, said second liquid receiving chamber is located between said second container and said first container, on an opposite side of said first container from said exhaust part, and a gap between a bottom surface of said first container and a bottom surface of said second container is included in said flow path.

13. The liquid ejection apparatus according to claim 11, wherein said ejecting part includes a plurality of head parts arranged in said movement direction, and said first liquid receiving chamber and said second liquid receiving chamber are each long in said movement direction and provided across said plurality of head parts, and each receive a liquid ejected from said plurality of head parts during maintenance.

14. The liquid ejection apparatus according to claim 11, wherein a surface in which said opening of said first liquid receiving chamber is provided is a closed surface, except far said opening, and a surface in which said opening of said second liquid receiving chamber is provided is a closed surface, except for said opening.

15. The liquid ejection apparatus according to claim 11, wherein said ejecting part ejects fine droplets of ink.

* * * * *